United States Patent [19]

Johnson

[11] 4,357,138

[45] Nov. 2, 1982

[54] CONTAINER EDGE FORMING APPARATUS

[75] Inventor: Warren E. Johnson, Bristol, Conn.

[73] Assignee: Sherwood Tool, Incorporated, Kensington, Conn.

[21] Appl. No.: 167,641

[22] Filed: Jul. 16, 1980

[51] Int. Cl.[3] ..... B31B 43/00

[52] U.S. Cl. ..... 493/159; 493/153

[58] Field of Search ..... 493/159, 158, 109, 104, 493/108, 105, 153

[56] References Cited

U.S. PATENT DOCUMENTS

| | | | |
|---|---|---|---|
| 1,249,399 | 12/1917 | Hood | 493/159 X |
| 1,578,426 | 3/1926 | Gordon | 493/159 X |
| 1,595,615 | 8/1926 | Peyser | 493/158 X |
| 2,130,518 | 9/1938 | Bach | 493/159 X |
| 2,286,692 | 6/1942 | Smith | 493/159 |
| 2,306,375 | 12/1942 | Bach | 493/159 X |
| 2,312,102 | 2/1943 | Krueger | 493/159 |
| 2,660,968 | 12/1953 | Livacich | 113/14 |
| 3,301,145 | 1/1967 | Bodendoerfer | 493/159 |

*Primary Examiner*—James F. Coan

*Attorney, Agent, or Firm*—McCormick, Paulding & Huber

[57] ABSTRACT

Apparatus for crimping a noncircular edge portion of a cup-shaped container or for rolling a bead on a noncircular edge portion of such a container includes a plurality of forming rollers supported on a rotary tool carrier for rotation with the tool carrier and relative to it. A roller follower associated with each forming roller and engaged within a stationary cam track causes each forming roller to travel in a noncircular path about the axis of the tool carrier as the tool carrier rotates about its axis. The tool carrier moves in an axial direction generally toward and away from a mandrel or receiver supporting the container to move the forming rollers into and out of forming engagement with a noncircular edge of the container.

13 Claims, 10 Drawing Figures

CONTAINER EDGE FORMING APPARATUS

BACKGROUND OF THE INVENTION

This invention relates in general to container forming machinery and deals more particularly with improved apparatus for forming noncircular edges of cup-shaped paper containers and the like. The present invention is particularly concerned with improved apparatus for crimping noncircular edges on containers of the aforedescribed general type or forming beads on noncircular edges of such containers. It is the general aim of the present invention to provide improved high speed container edge forming apparatus of a type particularly suitable for use at a work station on a cup forming machine of the type which includes at least one rotary indexible turret and cup forming mandrels and/or receivers mounted on the turret for supporting a container at various work stations.

SUMMARY OF THE INVENTION

In accordance with the present invention, apparatus for forming a noncircular edge of a cup-shaped container comprises a tool carrier, means supporting the tool carrier for rotation about an axis, at least one forming tool mounted on the tool carrier for rotation with the tool carrier, means for moving the one forming tool relative to the tool carrier to cause the forming tool to travel along a noncircular path around the axis of the tool carrier as the tool carrier rotates about its axis, and means for moving the tool carrier toward and away from the container supporting means to move the forming tool into and out of working engagement with a noncircular edge of a container supported by the supporting means.

DETAILED DESCRIPTION OF PREFERRED EMBODIMENT

Figures 1, 2, 3, 4, 5, 6, 7, 8:
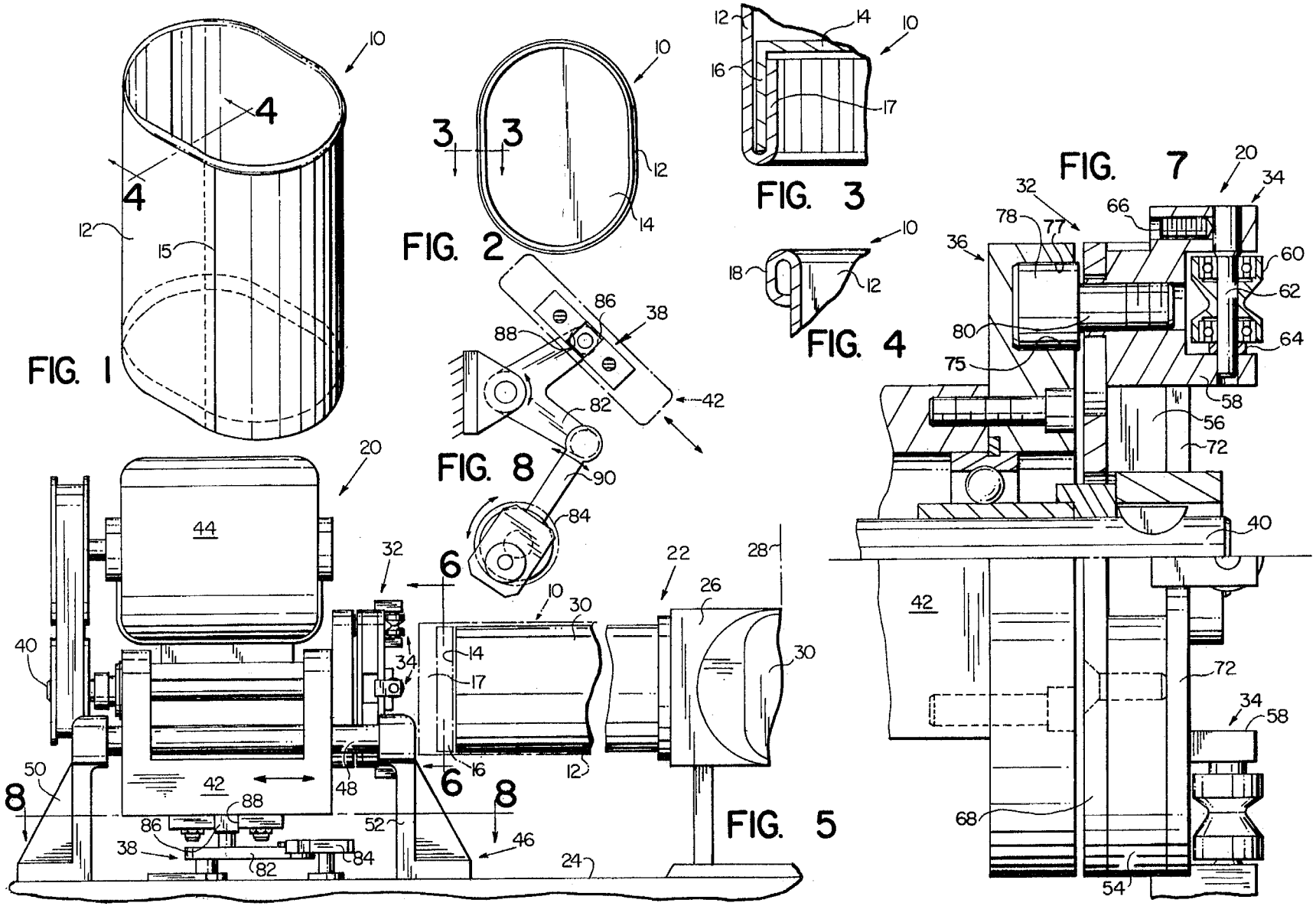
FIG. 1 is a perspective view of a typical container having marginal edge portions formed by apparatus in accordance with the present invention.
FIG. 2 is a bottom view of the container shown in FIG. 1.
FIG. 3 is a somewhat enlarged fragmentary sectional view taken along the line 3—3 of FIG. 2.
FIG. 4 is a somewhat enlarged fragmentary sectional view taken along the line 4—4 of FIG. 1.
FIG. 5 is a fragmentary side elevational view of a machine embodying the invention.
FIG. 6 is a somewhat enlarged fragmentary sectional view taken along the line 6—6 of FIG. 5.
FIG. 7 is a fragmentary sectional view taken generally along the line 7—7 of FIG. 6.
FIG. 8 is a sectional view taken along the line 8—8 of FIG. 5.

The present invention is concerned with improved apparatus for forming noncircular edges of disposable paper containers and the like. A typical container of the aforedescribed type, shown in FIGS. 1–4 and indicated generally by the reference numeral 10, is made from treated paper and has a substantially uniform noncircular cross-section characterized by a generally rectangular central portion and semi-circular opposite end portions, as best shown in FIG. 2. The container 10 has a side wall 12 made from a single generally rectangular sheet of treated paper formed to tubular configuration and having opposite marginal edges joined along a vertically extending overlapping seam 15. The container bottom indicated at 14 is preferably made from a single piece of treated paper and has an integral depending skirt 16. The side wall 12 and bottom 14 are joined by crimping a side wall lower marginal edge portion 17 inwardly against the skirt 16 as shown in FIG. 3. An outwardly rolled continuous bead 18 surrounds the upper open end of the container 10. Apparatus in accordance with the present invention may be used to crimp the marginal portion and/or roll the bead 18, as will be hereinafter further described.

Referring now to FIGS. 5–8, apparatus embodying the present invention, and indicated generally by the reference numeral 20, is illustrated with reference to a cup making machine designated generally by the numeral 22 in FIG. 5. The apparatus 20 comprises one work station of the machine 22 which may be generally characterized as a rotary turret cup making machine. The machine 22 has a frame or table 24 which supports one or more turrets such as the turret 26 shown in FIG. 5. The illustrated turret 26 is supported for rotation about the vertical axis 28 and carries a plurality of container support members or cup forming mandrels 30, 30 which extend radially outwardly from it. Each mandrel 30 has a noncircular cross-section which is uniform throughout the length of the mandrel to complement the interior cross-section of a container, such as the illustrated container 10. The turret is supported for indexing movement relative to the table and to a plurality of successive work stations arranged in equiangularly spaced relation and around the turret axis, in a manner well known in the container manufacturing art.

The illustrated apparatus 20 cooperates with the mandrels 30, 30 and is arranged to crimp the lower marginal edge 17 inwardly around the skirt 16 to marry the container side wall 12 to the bottom 14 and comprises a tool carrier, indicated generally at 32 and supported for rotation about a horizontal axis. At least one forming tool indicated generally at 34 is mounted on the tool carrier for rotation with it. A cam and follower mechanism, indicated generally at 36 and best shown in FIG. 7, moves the forming tool 34 relative to the tool carrier 32 as the tool carrier rotates about its axis to move the forming tool in a noncircular path about the axis of the tool carrier. The tool carrier 32 is moved generally toward and away from the turret 26 by a drive mechanism, indicated generally at 38 and shown in FIG. 8, to move the forming tool 34 into and out of working engagement with a noncircular edge of a container, such as the illustrated container 10 shown supported on an associated mandrel 30. The forming tool crimps the lower marginal edge portion 17 inwardly about the skirt 16, as will be hereinafter further discussed.

Considering now the apparatus 20 in further detail and referring particularly to FIG. 5, the tool carrier 32 is keyed to one end of a drive shaft 40 which is journalled for rotation on a tool carriage 42 and driven by a motor 44 supported on the tool carriage and drivingly connected to the other end of the shaft 40 by a drive belt and pulleys. The tool carriage is supported for sliding movement generally toward and away from the turret 26 by a cradle assembly indicated generally at 46, which includes a pair of slide rods 48, 48 supported above the surface of the table 24 by a pair of spaced apart brackets 50 and 52 fastened to the table surface.

Preferably, the tool carrier has a plurality of forming tools mounting on it. The illustrated tool carrier 32, best shown in FIGS. 6 and 7, carries four such forming tools 34, 34 arranged in equiangularly spaced relation about the axis of the drive shaft 40 and comprises a circular carrier plate 54 which is keyed to the forward end of the drive shaft 40. The carrier plate 54 has four equiangularly spaced and radially disposed slots 56, 56 which open outwardly through its peripheral edge. Each forming tool 34 includes a roller holder 58 slidably received within an associated slot 56 and a forming or crimping roller 60 journalled on the roller holder forward of the carrier plate 54 for free rotation about a generally radially disposed axis relative to the axis of the drive shaft 40. A typical roller holder, shown in section in FIG. 7, has a generally rectangular block-shape body portion which is received within an associated slot 56 in sliding engagement with the opposing walls of the slot. The roller holder 58 has a pair of radially spaced apart arms which are somewhat narrower than the slot 56 and which project forwardly beyond the carrier plate 54. The illustrated crimping roller 60 is journalled on a roller pin 62 which extends through the arms, substantially as shown. The outer end of the roller pin is diametrically enlarged and has an inwardly facing shoulder against which the outer bearing of the crimping roller 60 is seated. A spacing washer 64 is received on the pin 62 between the inner end of the crimping roller and the inner arm on the roller holder 58, substantially as shown in FIG. 7. A set screw 66 threaded into the outer arm engages the pin 62 and retains the pin, crimping roller and spacing washer in assembly with the roller holder 58.

The roller holders 58, 58 are retained in assembly with the carrier plate 54 by a circular plate 68 which is bolted to the rear surface of the carrier plate 54. Four radially extending slots 70, 70 (one shown in FIG. 6) extend through the retainer plate 68, each slot 70 being in registry with an associated slot 56 in the carrier plate 54. The slots 70, 70 are somewhat narrower than the associated slots 56, 56 in the carrier plate. Four retainer plate segments 72, 72 are bolted adjacent the forward surface of the carrier plate 54 between the roller holders 58, 58 and have marginal portions which extend inwardly beyond the associated walls of the slots 56, 56 and serve to further retain the roller holders within the slots 56, 56.

The cam and follower mechanism 36 for moving the crimping tools 34, 34 includes a stationary cam plate 74 fastened in fixed position to the tool carriage 42 rearwardly of the tool carrier 32. A forwardly opening noncircular cam track 76 formed in the cam plate 74 has a radially outwardly facing first wall 75 and a radially inwardly facing second wall 77. The cam track 76 receives roller followers 78, 78 carried by the roller holders 58, 58. Each roller follower 78 is mounted on an associated stud shaft 80 which passes through a slot 70 in the retainer plate and is threadably engaged in an associated roller holder.

Referring now particularly to FIGS. 5 and 8, the drive mechanism 38 for moving the tool carriage 42 comprises a crank 82 and an eccentric 84. One end of the crank is pivotally connected to a slide block 86 received within a slot 88 in the tool carriage. The other end of the crank 82 is connected to the eccentric 84 by a link 90. The eccentric is driven in timed relation with the turret drive mechanism so that the tool carriage 42 is moved toward and away from the turret 26 only when an associated one of the mandrels 30, 30 is at rest at the work station 20 and in alignment with the tool carrier 32.

As previously noted, the machine 22 includes a plurality of work stations, however, only the work station 20 is shown. The side wall 12 of a container is formed by wrapping a single generally rectangular sheet of treated paper around an associated mandrel 30 and joining opposite marginal edges of the sheet to form the overlapping seam 15. The side wall 12 is positioned on the mandrel so that its marginal edge portion 17 extends beyond the outer end of the mandrel, as best shown in FIG. 5 where the partially formed container 10 is shown in phantom. The container bottom 14 is preferably die cut from a single piece of treated paper and pressed to form the skirt portion 16. The preformed bottom 14 is positioned within the extending portion of the container side wall 12 and adjacent the outer end of the mandrel before the turret indexes the mandrel to the work station 20. The marginal edge portion 17 and the skirt 16 may, if desired, be heated to cause the treated paper to become tacky just prior to being indexed into position at the work station 20.

After a mandrel 30 with a partially formed container 10 thereon has indexed to position at the work station 20 the drive mechanism 38 operates to move the tool carrier 32 toward the mandrel and into working engagement with the marginal portion 17 exposed beyond the end of the mandrel. The tool carrier 32 is continuously rotated about its axis by the drive motor 46. The roller followers 78, 78 engaged within the cam tract 76 drive each of the crimping rollers 60, 60 in a noncircular path about the axis of the tool carrier 32 as the tool carrier rotates about its axis.

Figure 9:
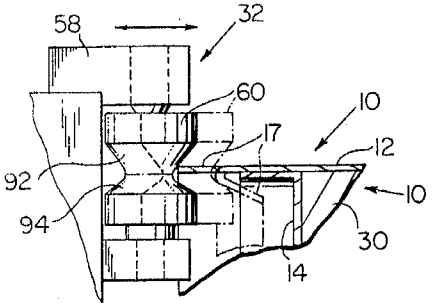
FIG. 9 is a somewhat schematic view of a crimping tool shown in crimping engagement with the bottom edge of a container.
Figure 6:
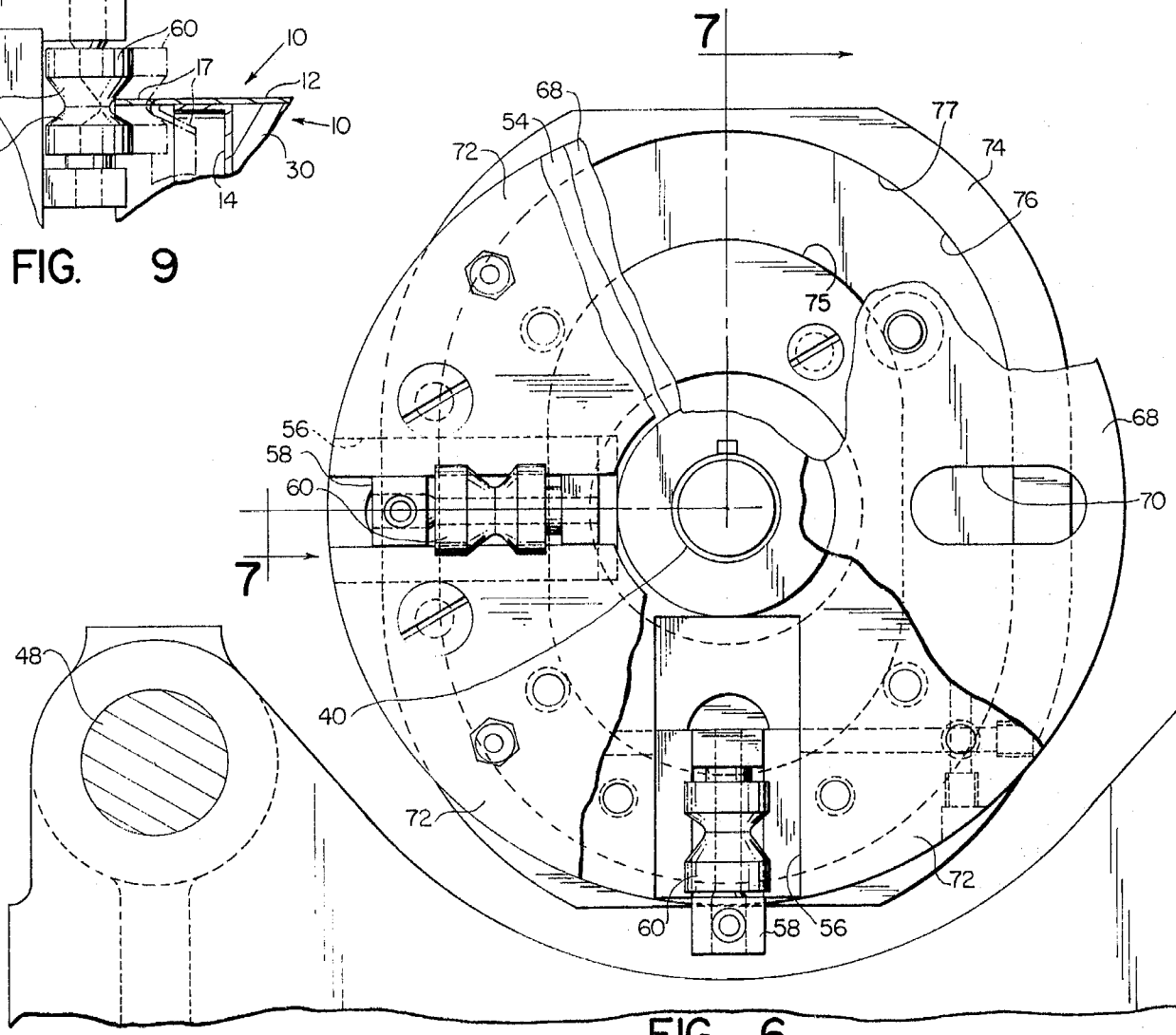

Referring now to FIG. 9, each crimping roller 60 has a generally hourglass shape defined by a radially inwardly converging conical outer portion 92 and a radially outwardly converging conical inner portion 94. As the crimping rollers 60, 60 move into engagement with the exposed marginal edge portion 17 the latter edge portion is engaged by the crimping roller outer portions 92, 92, as shown in solid lines in FIG. 9 causing the marginal portion 17 to curl radially inwardly or toward the axis of the tool carrier 32. As the crimping roller continues to move toward the mandrel the marginal portion 17 is engaged by the crimping roller inner portions 94, 94, directed into the cavity in the bottom 14, and to a position of generally crimped engagement with the skirt 16 whereby to complete the crimping operation. The drive mechanism 38 then moves the tool carrier 32 away from the mandrel 30 and out of working engagement with the container 10. Thereafter, the turret 26 may index the illustrated mandrel and container 10 to another work station (not shown) where a conventional expander presses the marginal portion 17 into tight sealing engagement with the skirt 16.

If it should be necessary to adjust the position of one or more of the crimping rollers to control deformation of the marginal edge portion 17, this adjustment may be made by loosening the set screw 66, removing the roller pin 62 and replacing the spacing washer 64 with another washer of a greater or lesser thickness, as may be required, to position the roller for proper initial engagement with the extending marginal edge portion 17.

Figure 10:
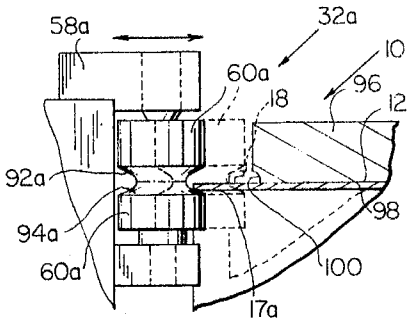
FIG. 10 is similar to FIG. 9 but illustrates another embodiment of the invention.

As previously noted, apparatus embodying the present invention may also be used to form a bead on a noncircular edge portion of a cup-shaped container or the like. Referring now to FIG. 10 another apparatus embodying the invention and indicated generally at 20*a* forms the outwardly projecting bead 18 on the noncircular upper marginal edge portion of a container 10, the upper marginal portion being indicated at 17*a*. The apparatus 20*a* is similar in most respects to the apparatus 20 previously described, but differs therefrom in the shape of its forming rollers, a typical forming roller being indicated at 60*a*. Other parts of the apparatus which correspond to parts of the apparatus 20 previously described, bear the same reference numerals as the previously described parts and a letter "a" suffix and will not be hereinafter further described.

The apparatus 20*a* is used in cooperation with a container or cup receiver 96 which is mounted on a turret, such as the turret 26 previously described. The receiver 96 has a cavity 98 of noncircular cross-section for receiving and complementing the cup 10. The receiver also has a radially disposed end wall and a noncircular groove 100 formed within the end wall in surrounding relation to the cup receiving cavity 98. The forming roller 60*a* has a generally hourglass shape, however, the conical outer and inner portions indicated at 92*a* and 94*a*, respectively, are of a slightly different configuration than those of the previously described crimping roller 60.

The bead forming roller 60*a* is positioned so that the inner portion 94*a* first engages the extending outer marginal portion 17*a* to deflect the latter marginal portion radially outwardly relative to the axis of the tool rotating carrier 32*a* as the tool carrier moves toward the receiver 96. As the bead forming roller 60*a* continues to advance in the direction of the receiver 96 the marginal edge portion 17*a* is engaged by the conical outer portion 92*a* and is curled in the direction of the receiver 96 and into the groove 100 whereby the noncircular bead 18 is formed in surrounding relation with the open end of the container 10. The tool carrier 32*a* is then moved out of working relation with the cup 10 by its crank mechanism so that the cup receiver 96 with the cup 10 therein may index to the next successive work station where the finished cup may be ejected from the machine.

I claim:

1. Apparatus for forming a non-circular edge of a cup-shaped container, said apparatus comprising means for supporting a container, a movable tool carriage, means supporting said tool carriage for movement generally toward and away from said container supporting means, a tool carrier, means supporting said tool carrier on said tool carriage for movement with said tool carriage and rotation about a tool carrier axis relative to said tool carriage, at least one forming tool mounted on said tool carrier for rotation with said tool carrier relative to said tool carriage and for rectilinear radial movement relative to said tool carrier and toward and away from said tool carrier axis, first positive positioning means mounted in fixed position on said tool carriage to move with said tool carriage and said tool carrier toward and away from said container supporting means for moving said one forming tool radially outwardly relative to said tool carrier axis, second positive positioning means mounted in fixed position on said tool carriage to move with said tool carriage and said tool carrier toward and away from said container supporting means for moving said one forming tool radially inwardly relative to said tool carrier axis, said first and second positive positioning means coacting to move said one forming tool along a definite predetermined noncircular path around said tool carrier axis in response to rotation of said tool carrier about said tool carrier axis, and means for moving said tool carriage toward and away from said container supporting means to move said forming tool into and out of working engagement with an edge of a container supported by said supporting means.

2. Apparatus for forming a noncircular edge of a cup-shaped container as set forth in claim 1 and including a cam plate mounted in fixed position on said tool carriage and defining a continuous noncircular cam track having a radially inwardly facing first wall and a radially outwardly facing second wall and a cam follower associated with said one forming tool and engaged within said track, said first wall comprising said first positive positioning means and said second wall comprising said second positive positioning means.

3. Apparatus for forming a noncircular edge of a cup-shaped container as set forth in claim 2 and including a drive shaft journalled on said tool carriage and projecting through said cam plate in the direction of said container supporting means, and wherein said tool carrier comprises a carrier plate mounted in fixed position on the projecting portion of said drive shaft.

4. Apparatus for forming a noncircular edge of a cup-shaped container as set forth in claim 3 including a drive motor mounted in fixed position on said tool carriage and drivingly connected to said drive shaft.

5. Apparatus for forming an edge of a cup-shaped container as set forth in claim 1 including a plurality of sets of forming tools, each of said sets including two diametrically opposed forming tools.

6. Apparatus for forming an edge of a cup-shaped container as set forth in claim 3 wherein said forming tool includes a tool holder supported for sliding movement in a slot in said carrier plate and a tool element mounted on said tool holder.

7. Apparatus for forming a noncircular edge of a cup-shaped container as set forth in any one of claims 1, 2 or 3 wherein said forming tool comprises a roller.

8. Apparatus for forming a noncircular edge on a cup-shaped container as set forth in any one of claims 1, 2 or 3 wherein said forming tool is supported for rotation about an axis extending radially of said tool carrier axis.

9. Apparatus for forming a noncircular edge of a cup-shaped container as set forth in any one of claims 1, 2 or 3 wherein said container supporting means comprises a mandrel and said forming tool is arranged to deform the noncircular edge in a radially inward direction relative to said tool carrier axis.

10. Apparatus for forming a non-circular edge of a cup-shaped container as set forth in any one of claims 1, 2 or 3 wherein said container supporting means comprises a container receiver and said forming tool is arranged to deform the noncircular edge in a radially outwardly direction relative to said tool carrier axis.

11. Apparatus for forming an edge of a cup-shaped container as set forth in claim 6 including means for adjusting the position of said tool element relative to said tool holder.

12. Apparatus as set forth in claim 6 wherein said tool element comprises a roller journalled for rotation on said tool holder.

13. Apparatus as set forth in claim 12 wherein said roller is journalled for rotation about an axis extending radially of said tool carrier axis.

* * * * *